US008515092B2

(12) United States Patent
Rucker

(10) Patent No.: US 8,515,092 B2
(45) Date of Patent: Aug. 20, 2013

(54) INTERACTIVE TOY FOR AUDIO OUTPUT

(75) Inventor: Austin Rucker, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 704 days.

(21) Appl. No.: 12/642,333

(22) Filed: Dec. 18, 2009

(65) Prior Publication Data

US 2011/0151746 A1 Jun. 23, 2011

(51) Int. Cl.
*H04R 1/02* (2006.01)

(52) U.S. Cl.
USPC ..... 381/87; 381/56; 381/123; 446/175; 86/464 R

(58) Field of Classification Search
USPC ..... 446/175, 484, 297, 397; 381/56, 381/123, 87, 109, 104, 150, 332, 333; 84/464 R, 484, 470 R; D14/190, 189, 188
See application file for complete search history.

(56) References Cited

U.S. PATENT DOCUMENTS

| | | | | |
|---|---|---|---|---|
| 3,912,694 | A | 10/1975 | Chiappe et al. | |
| 4,245,430 | A | 1/1981 | Hoyt | |
| 4,339,711 | A * | 7/1982 | Inami et al. | 324/76.31 |
| 4,450,495 | A | 5/1984 | Naruki | |
| 4,521,205 | A | 6/1985 | Spector | |
| 4,579,540 | A | 4/1986 | Ho | |
| 4,642,710 | A | 2/1987 | Murtha et al. | |
| 4,654,659 | A | 3/1987 | Kubo | |
| 4,717,364 | A | 1/1988 | Furukawa | |
| 4,828,527 | A | 5/1989 | Spector | |
| 4,923,428 | A | 5/1990 | Curran | |
| 5,032,099 | A | 7/1991 | Chan | |
| 5,209,695 | A | 5/1993 | Rothschild | |
| 5,541,360 | A | 7/1996 | Kaneko | |
| 5,603,652 | A | 2/1997 | Rothschild et al. | |
| 5,621,805 | A | 4/1997 | Loh et al. | |
| 5,652,797 | A | 7/1997 | Okamura et al. | |
| 5,674,076 | A | 10/1997 | Billings et al. | |
| 5,791,965 | A | 8/1998 | Kim | |
| 6,025,553 | A | 2/2000 | Lee | |
| 6,079,985 | A | 6/2000 | Wohl et al. | |
| 6,149,490 | A | 11/2000 | Hampton et al. | |
| 6,232,539 | B1 | 5/2001 | Looney et al. | |
| 6,464,585 | B1 | 10/2002 | Miyamoto et al. | |
| 6,524,157 | B1 | 2/2003 | Ryan | |
| 6,530,818 | B1 | 3/2003 | Stuntz et al. | |
| 6,758,716 | B1 | 7/2004 | Rehkemper et al. | |

(Continued)

FOREIGN PATENT DOCUMENTS

| | | |
|---|---|---|
| GB | 2263573 | 7/1993 |
| GB | 2287115 | 9/1995 |

(Continued)

*Primary Examiner* — Vivian Chin
*Assistant Examiner* — Con P Tran
(74) *Attorney, Agent, or Firm* — Kolisch Hartwell, PC

(57) ABSTRACT

An interactive toy for audio output is provided having a speaker contained within a housing, connected to an electrical signal defining an audio output to be generated by the speaker. The housing may include a humanoid face defined at least in part by lights contained within the housing; and an information processor that measures a variable audio characteristic of the electrical signal, prompts a user to change the variable audio characteristic and controls a pattern scheme for the lights. A pattern scheme for the lights may include a first pattern scheme in which the lights illuminate in multiple ascending groups and a second pattern scheme in which the lights illuminate in multiple descending groups.

20 Claims, 2 Drawing Sheets

(56) References Cited

U.S. PATENT DOCUMENTS

| | | | | |
|---|---|---|---|---|
| 6,863,587 | B1 | 3/2005 | Bennett | |
| 6,953,886 | B1 | 10/2005 | Looney et al. | |
| 6,997,773 | B1 | 2/2006 | Dubois et al. | |
| 7,047,105 | B2 | 5/2006 | Kakutani et al. | |
| 7,078,609 | B2 | 7/2006 | Georges | |
| 7,081,582 | B2 | 7/2006 | Basu | |
| 7,176,372 | B2 | 2/2007 | Georges | |
| 7,215,786 | B2 | 5/2007 | Nakadai et al. | |
| 7,220,911 | B2 | 5/2007 | Basu | |
| 7,227,965 | B1 | 6/2007 | Sutton | |
| 7,294,060 | B2 | 11/2007 | Ferrigno et al. | |
| 7,351,148 | B1 | 4/2008 | Rothschild et al. | |
| 7,431,630 | B2 | 10/2008 | Dubois et al. | |
| 7,442,107 | B1 | 10/2008 | Ueda et al. | |
| 2002/0081937 | A1* | 6/2002 | Yamada et al. | 446/175 |
| 2005/0091684 | A1 | 4/2005 | Kawabata | |
| 2005/0124387 | A1 | 6/2005 | Ribeiro | |
| 2005/0144016 | A1 | 6/2005 | Hewitt | |
| 2006/0246814 | A1 | 11/2006 | Todokoro | |
| 2006/0274905 | A1 | 12/2006 | Lindahl | |
| 2007/0039450 | A1* | 2/2007 | Ohshima et al. | 84/616 |
| 2007/0042672 | A1 | 2/2007 | Tawil | |
| 2007/0060020 | A1* | 3/2007 | Civettini et al. | 446/484 |
| 2007/0064954 | A1 | 3/2007 | Booth | |
| 2007/0074618 | A1 | 4/2007 | Vergo | |
| 2007/0087652 | A1 | 4/2007 | Hsu | |
| 2007/0089592 | A1* | 4/2007 | Wilson et al. | 84/612 |
| 2007/0183618 | A1 | 8/2007 | Ishii | |
| 2007/0253580 | A1 | 11/2007 | Sutton | |
| 2007/0253581 | A1 | 11/2007 | Sutton | |
| 2007/0270074 | A1 | 11/2007 | Aochi | |
| 2007/0280489 | A1 | 12/2007 | Roman | |
| 2008/0069383 | A1 | 3/2008 | Kohno | |
| 2008/0075296 | A1 | 3/2008 | Lindahl | |
| 2008/0077388 | A1 | 3/2008 | Nash | |
| 2008/0090489 | A1 | 4/2008 | Baytman | |
| 2008/0156178 | A1 | 7/2008 | Georges | |
| 2009/0034766 | A1 | 2/2009 | Hamanaka | |
| 2009/0098791 | A1 | 4/2009 | Wang | |
| 2009/0107320 | A1 | 4/2009 | Willacy | |
| 2009/0117816 | A1 | 5/2009 | Nakamura | |
| 2009/0117819 | A1 | 5/2009 | Nakamura | |
| 2009/0132242 | A1 | 5/2009 | Wang | |
| 2009/0139389 | A1 | 6/2009 | Bowen | |
| 2009/0178542 | A1 | 7/2009 | Jochelson | |
| 2009/0197504 | A1 | 8/2009 | Hsu | |
| 2011/0034103 | A1* | 2/2011 | Fong et al. | 446/297 |

FOREIGN PATENT DOCUMENTS

| | | |
|---|---|---|
| GB | 2288987 | 11/1995 |
| GB | 2365616 | 2/2002 |
| GB | 2370405 | 6/2002 |
| JP | 08280082 | 10/1996 |
| JP | 09311688 | 12/1997 |
| JP | 2006106411 | 4/2006 |
| JP | 2006198017 | 8/2006 |
| WO | 02/056292 | 7/2002 |
| WO | 2004021274 | 4/2004 |
| WO | 2006077868 | 7/2006 |
| WO | 2008042917 | 11/2008 |

* cited by examiner

INTERACTIVE TOY FOR AUDIO OUTPUT

FIELD OF THE DISCLOSURE

The present disclosure relates to generally to toys for audio output, and more particularly to interactive toys for audio output having a humanoid face configured to display one of at least a first pattern scheme and a second pattern scheme.

BACKGROUND

Toys for audio output are useful for children as amusement devices that allow a child to play music. An interactive toy for audio output may further benefit and/or amuse the child by allowing the child to emotionally and physically respond to the toy, thereby providing a musical educational experience for the child.

Examples of toys/devices for audio output, and/or interactive devices for audio output are disclosed in U.S. Pat. Nos. 5,541,360, 5,621,805, 5,652,797, 6,079,985, 7,227,965, and in U.S. Publication Nos. US20070270074 and US20070060020. The disclosures of these and all other publications referenced herein are incorporated by reference in their entirety for all purposes.

SUMMARY

In one example, an interactive toy for audio output is provided having a speaker contained within a housing, and the speaker is connected to an electrical signal defining an audio output to be generated by the speaker. The housing may include a humanoid face defined at least in part by lights contained within the housing; and an information processor that measures a variable audio characteristic of the electrical signal, prompts a user to change the variable audio characteristic, and controls a pattern scheme for the lights. A pattern scheme for the lights may include a first pattern scheme in which the lights illuminate in multiple ascending groups and a second pattern scheme in which the lights illuminate in multiple descending groups.

In some embodiments, the selection of the first pattern scheme or the second pattern scheme may be dependent on the measured variable audio characteristic. The variable audio characteristic may be the tempo or beats-per-minute of the audio output and/a displayed pattern scheme may include a peak meter of the audio output. The information processor may further notify the user if the variable audio characteristic has been changed correctly or incorrectly. Some embodiments of an interactive toy may also include a carrying handle, wherein the position of the carrying handle may determine a mode of play or operation of the interactive toy.

The advantages of the present disclosure will be understood more readily after a consideration of the drawings and the Detailed Description.

DETAILED DESCRIPTION

Figure 1:
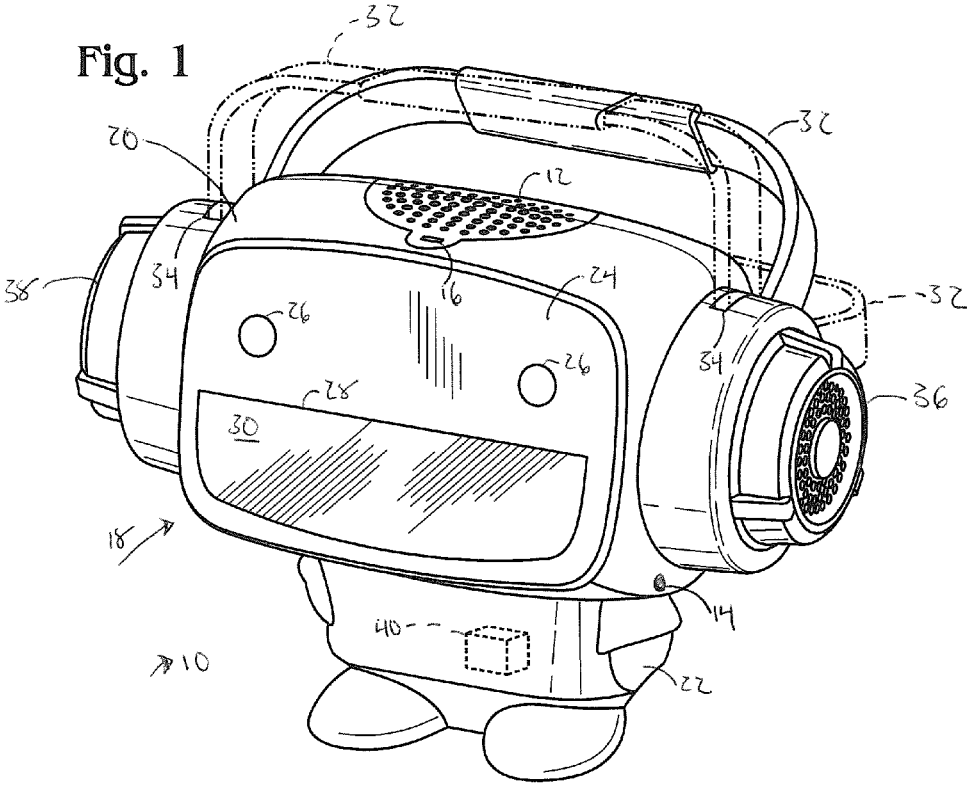
FIG. 1 a perspective view of an interactive toy for audio output with a carrying handle and a humanoid face in accordance with the present disclosure.

FIG. 1 is a front perspective view of an interactive toy for audio output, indicated generally at 10, in accordance with the present disclosure. Interactive toy 10 may include a speaker 12, connected by wires, not shown, to an electrical signal defining an audio output. The electrical signal may be generated internal to toy 10, or it may be supplied through a jack 14 or socket for connection to an external music player. User-generated audio may be input through a microphone 16. Speaker 12, jack 14 and/or microphone 16 may be contained within a housing 18 configured to represent a fictionalized character or shape, including that of a humanoid doll having a head portion 20 and a body portion 22. Other embodiments of an interactive toy may include a housing having a different appearance and/or shape.

Head portion 20 may be at least partially supported by the body portion 22 and may include a face region 24. Face region 24 may have a humanoid facial appearance and may be at least partially defined by lights contained within housing 18. For example, face region 24 may have eyes 26 and a mouth area 28 including an LED screen 30 configured to display a light pattern scheme. A light pattern scheme may have any configuration including at least a first pattern scheme and a second pattern scheme as explained in more detail with reference to FIGS. 2-4.

Housing 18 may also include a carrying handle 32 rotatably attached to head portion 20 at either side of face region 24. Head portion 20 may include channels 34 at either side of face region 24, defining a path of travel for the carrying handle 32. Preferably, it is an approximately 90-degree path of travel. Carrying handle 32 may be positionable to one or more positions within the channels and each handle position may be associated with a mode of operation.

For example, carrying handle 32 may have a first position associated with an off mode, and a second position associated with an interactive or "feed-me" mode. In the first position, the interactive toy 10 may be powered off and carrying handle 32 may be at an approximately horizontal position (0-degree) with respect to the ground. In the second position, the interactive toy may be powered on and in an interactive or "feed me" mode and may be at an approximately 45-degree angle with respect to the ground. Carrying handle 32 may further include a third position, hereinafter referred to as a speaker mode, in which carrying handle 32 may be approximately at vertical (90-degree) angle with respect to the ground.

Housing 18 may further include one or more control knobs at either side of face region 24. For example, head portion 20 may have a first control knob 36 that is manipuable by a user to change a variable audio characteristic, for example by rotation of the first control knob 36 in a clockwise and/or counter clockwise direction to change the tempo of the audio output. The first control knob 36 may be operable to change the variable audio characteristic when the interactive toy 10 is in feed-me mode and/or the carrying handle 32 is in the second position. The first control knob 36 may further be configured to be pushed in to change one or more additional operations of the interactive toy 10. A second control knob 38 may be similarly operable to change a variable audio characteristic, for example, to raise and lower the volume of the audio output and/or operate microphone 16. Handle 34, first control knob 36, and second control knob 38 collectively create a visual simulation of audio headphones worn by a fictionalized character.

Interactive toy 10 may further include an information processor 40. Information processor 40 may be configured to measure one or more variable audio characteristics of the electrical signal connected to speaker 12, including but not limited to the tempo, or beats-per-minute, of the electrical signal. Information processor 40 may continually measure the variable audio characteristic and/or measure the variable audio characteristic at preset or random intervals. Selection by information processor 40 of the first pattern scheme and the second pattern scheme may be dependent on the measured variable audio characteristic.

Information processor 40 may further be configured to audibly and/or visually prompt a user to change a variable audio characteristic when the carrying handle 32 is in the second position and/or the interactive toy 10 is in feed me mode. Information processor 40 may also notify the user if the variable audio characteristic has been changed correctly or incorrectly.

Figure 2:
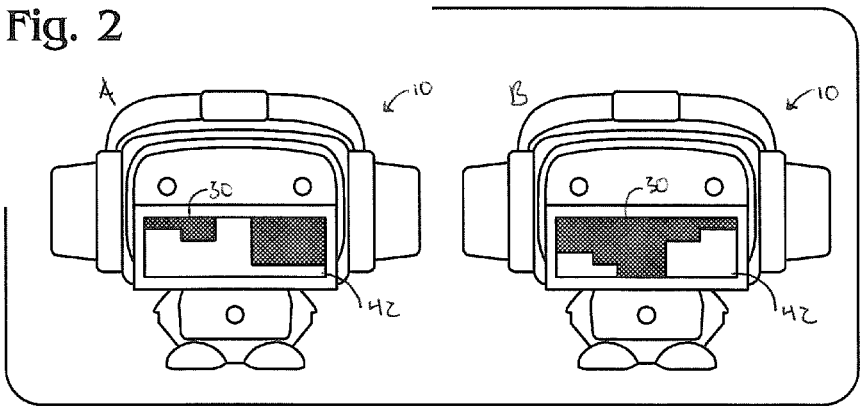
FIGS. 2 A-B are front views of the interactive toy of FIG. 1, collectively showing a first pattern scheme in accordance with the present disclosure.

FIGS. 2-5 depict interactive toy 10 including exemplary light pattern schemes in accordance with the present disclosure. Interactive toy 10 may be configured to display one or all of the light pattern schemes depicted in FIGS. 2-5. FIG. 2 shows a series of images A-B of interactive toy 10 with LED screen 30 displaying a first pattern scheme 42 in which lights illuminate in multiple ascending groups. First pattern scheme 42 may imitate a peak meter. Additionally and/or alternatively, first pattern scheme 42 may be dependent on sound levels within each of a plurality of frequency bands of the audio output.

Figure 3:
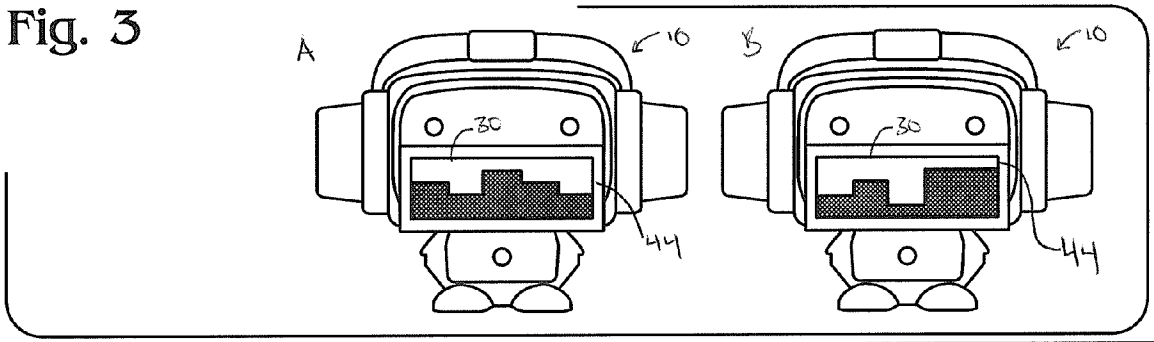
FIGS. 3 A-B are a series of front views of the interactive toy of FIG. 1, collectively showing a second pattern scheme in accordance with the present disclosure.

FIG. 3 is a series of images A-B of interactive toy 10 with LED screen 30 displaying a second pattern scheme 44 in which lights illuminate in multiple descending groups. Second pattern scheme 44 may display an inverse image as first pattern scheme 42. Additionally and/or alternatively, second pattern scheme 44 may imitate a peak meter or may be dependent on sound levels within each of a plurality of frequency bands of the audio output.

Figure 4:
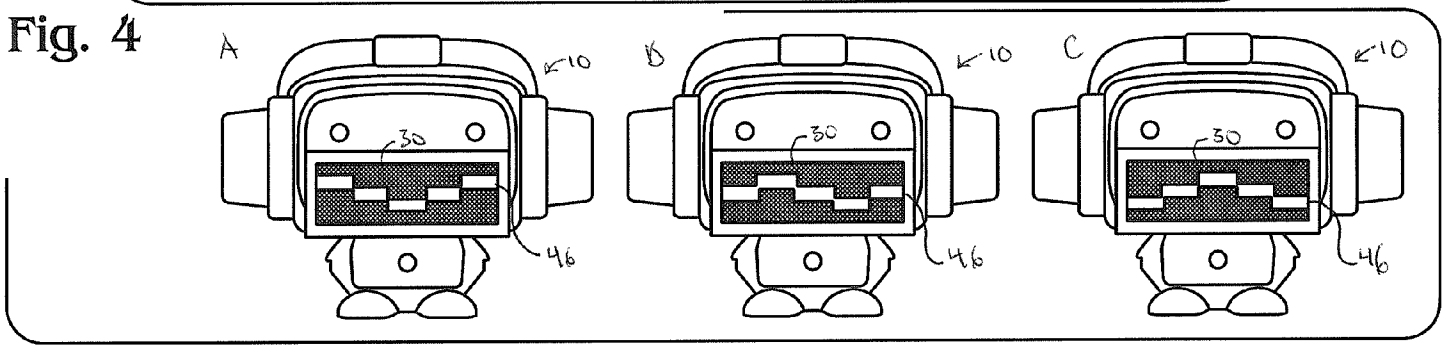
FIGS. 4 A-C are a series of front views of the interactive toy of FIG. 1, collectively showing a third pattern scheme in accordance with the present disclosure.
Figure 5:
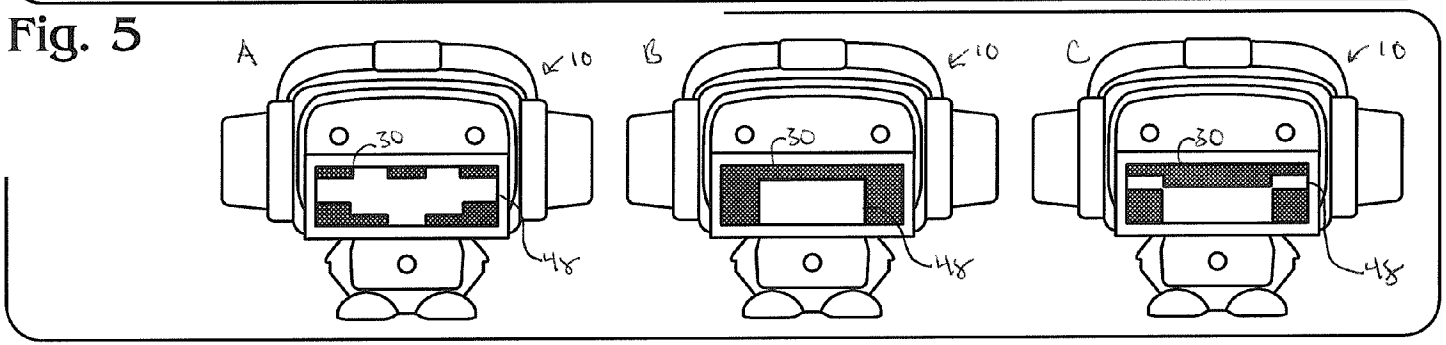
FIGS. 5 A-C are a series of front views of the interactive toy of FIG. 1, collectively showing a fourth pattern scheme in accordance with the present disclosure.

FIG. 4 is a series of images A-C of interactive toy 10 with LED screen 30 displaying a third pattern scheme 46 in which lights illuminate in an approximate sine wave pattern. FIG. 5 is a series of images A-C of interactive toy 10 with LED screen 30 displaying a fourth pattern scheme 48 in which lights illuminate to approximate or imitate the movement of a human mouth talking, laughing, frowning and/or smiling.

The following is an exemplary description of an interactive toy for audio output in accordance with the present disclosure. The interactive toy may be described as an urban vinyl music toy with a headphone handle. The interactive toy may have a personality of a hip MC beat-boxer who knows how to kick a party into high gear. The interactive toy may be smart-alecky, cheeky, loud and a little bit of an attention hound. The interactive toy may feature a LED mouth grid that may function as both a form of personal expression (showing smiles, frowns, lips moving, etc), as well as a peak meter for when music is being played through the interactive toy. The interactive toy may also include an onboard microphone and a 3.5 mm jack for connecting to an external music player. The interactive toy may be able to record five seconds of audio through the microphone or through the 3.5 mm line in.

A user may play music through the interactive toy and interact with the interactive toy like a buddy. The interactive toy is an interactive music player that offers music mixing, sound effects overlays on top of music or recordings, funny banter, and impressive light shows, for example via the LED mouth grid.

Using the interactive toy for audio output, the user may:

Plug an MP3 player into jack of the interactive toy to listen to music

Record audio or music using a record button and the microphone, then use a beat-box feature to overlay sound effects (SFX) on the recorded audio.

Interact with the interactive toy, for example the interactive toy may respond to sounds from the user using the onboard microphone.

Listen to music while carrying the interactive toy around using the headphones as a handle.

Jam along to music with the interactive toy in Feed Me mode, or use the interactive toy as a portable speaker.

The controls and input of the interactive player may be described as follows:

First Button—may be rotated forward or backward and can be pushed in when not rotated.

1. Plays last recorded Audio. If no audio recorded, plays SFX.
2. Creates less effects during Beat-box mode if rotated towards user
3. Creates more effects during Beat-box mode if rotated away from user Second Button—may be rotated forward or backward and can be pushed in when not rotated.

1. Push-in to record sounds or music for up to 5 seconds
2. Slows speed (BPM down) if rotated towards user
3. Increases speed (BPM up) if rotated away from user Headphone Handle Handle may be rotatable from the horizontal position (0 degree), to diagonal position (45 degree) and vertical position (90 degree) to change modes.

1. At 0 degree the interactive toy is off and the headphone is horizontal, extending away from the user.
2. At 45 degrees the interactive toy is in Feed Me mode. If no music is playing through line-in, the interactive toy may default to Idle mode in this position until music resumes.
3. At 90 degrees the interactive toy is in Speaker Mode. If no music is playing through line-in, the interactive toy may default to Idle mode in this position until music resumes.

Microphone

Onboard mic may listen for audio when in IDLE/MIMIC mode. Interactive toy can record audio to onboard FLASH API using the mic.

1. Generates a low level peak meter when detecting ambient noise in idle mode.
2. Detects Sound and uses a low volume threshold to trigger "aware" SFX & VFX.
3. Sustained High volume detection may trigger audio recording to FLASH API.
4. Mic is disabled when music is playing through line-in to prevent feedback loop.

Speaker and 3.5 mm Audio Jack

Line-in can detect state of music playing thru 3.5 mm audio jack.

1. Detects if 3.5 mm jack is plugged in.
2. Detects if 3.5 mm jack is unplugged.
3. Detects if an audible level of audio is playing through the interactive toy.
4. Detects if Audio not playing; line-in is active, but no audible sound is passing through interactive toy to speaker.

Idle Timers

Counter timers used to trigger events in all modes.

1. Idle Timers may trigger Idle Audio and SFX in IDLE/MIMIC mode when no input is detected.
2. Idle Timers may trigger music requests in Feed Me mode.
3. Idle Timers may trigger BPM comparison in Feed Me mode.
4. Idle Timers may trigger random VFX in speaker mode.
5. Idle Timers may trigger interactive toy OFF when no input is detected after 5 minutes.
6. Idle Timers may trigger SFX/VFX 1 min after interactive toy shuts OFF before turning completely OFF.

The one or more play modes or states of the interactive toy for audio output may be described as follows:

Idle

In Idle State, as timers are triggered, the interactive toy may pull from a database of idle sound effects (SFX) and visual effects (VFX) outputs. Idle state may be active so long as an active 3.5 mm jack is not plugged into the interactive toy. The interactive toy can revert to Idle Mode if no audible audio is picked up by the plugged in 3.5 mm jack. Based on the position of the handle, the interactive toy may return to its previous mode (speaker or feed me mode) once audible audio is detected from the line-in again.

Idle mode may contain a sound threshold that, once passed, may trigger either an Aware SFX/VFX response or prompt the microphone to record audio. Record may only be active when the sound threshold is passed and sustained for longer than 500 ms.

Sound Threshold—Generally, most ambient noise should only generate a low peak meter on the LED mouth grid. During this time, the interactive toy may periodically play Idle animations. The interactive toy may only play aware SFX/VFX if the threshold is broken but not maintained. If the Threshold is broken and maintained, the interactive toy may record.

Mimic—Once the interactive toy has detected a sustained loud noise, the interactive toy may record, then play back the audio with a distortion. After the audio finishes, the interactive toy may occasionally play a specific taunt, laugh or smirk SFX.

Beatbox

This is a unique, interactive mode that can be accessed at any time in any mode. When a user holds down the record button, records audio, then pushes play to hear the playback, the user can then overlay SFX, or Looped SFX by rotating the first button or alter the BMP of the playback to be faster or slower by rotating the second button.

Record Function—The user pushes in the second button to record music through the line-in or voice through the microphone. As the interactive toy begins recording, a recording VFX may play. Once the recording space is full, the interactive toy may disable the Line-in and mic and prompt the user with VFX and SFX to press play. If the user fails to press play, the interactive toy may repeat the prompt, then default back to the previous state, turning on the mic, or the Line-in if available.

BeatBox—In order to overlay SFX onto the recording, the first button needs to be rotated forward or backward. If the user rotates the first button in either direction then releases, a single SFX may overlay onto the recording. If the user rotates and holds the button, a SFX loop may play until the button is released. Every time a SFX is overlaid in the last 1 second of playback, the playback may loop an additional time.

Play Button—Pushing play may start the audio playback of recorded audio from the FLASH API. Pushing in the play button at any time may restart the recorded audio. If no voice or music has been recorded, the interactive toy may prompt the user to hold down the record button using a SFX and VFX arrow animation.

Feed Me

The purpose of this mode is to give users a dynamic music listening experience by having the interactive toy tell them what type of music to listen to. When music is connected to the interactive toy while the handle is in the 45° position, the interactive toy may enter Feed Me mode. During this time, the interactive toy mouth may display a peak meter for the music playing. Periodically, idle timers may trigger the interactive toy to interrupt the peak meter and request a particular speed of music (fast, faster, slow, or slower).

After the interactive toy makes the request, the user has 1 minute to match or exceed the requested BPM. Once the Requested BPM has been matched successfully, the interactive toy may reward the user with positive banter—negative banter may be used if the user fails to meet the BPM requirements. Multiple successful matches may reward the user with even more unique banter. Multiple unsuccessful matches may cause the interactive toy to become upset. This may be noticeable through audible comments and/or VFX.

Volume Changes—During feed-me mode, the interactive toy can recognize when the music is not playing but line-in is active, the interactive toy can recognize when volume drops to inaudible levels for more than 5 seconds. The interactive toy can recognize when the volume increases dramatically in less than a second. The interactive toy can recognize when volume levels are audible but very low for more than 10 seconds. Each of these 4 conditions trigger a SFX/VFX response.

Speaker Mode

Speaker mode may be active when music is connected to the interactive toy while the handle is vertical (90°) position. During this mode, the interactive toy dynamic peak meter may play along with the music. Idle timers may interrupt the music periodically in order to play additional animation or "Lightshows". Lightshows are fun animations that provide visual interest for the user.

The following description is of examples of the various modes available for an interactive toy for audio output in accordance with the present disclosure.

Mimic Mode Example: the interactive toy may attempt to repeat spoken words back to the user Mimic Turn ON the interactive toy to either 45° or 90° with no line-in active.

Intro Audio Plays

Wait for input from user

If the interactive toy hears a noise that exceeds volume threshold the interactive toy Mimics 5 seconds of recorded Audio the interactive toy applies a distortion to the recorded audio then plays the distorted recorded audio immediately.

New Audio is recorded every time threshold is passed

Idle Mode Example: the Process of when the Interactive Toy is not being Used

Idle

Turn ON the interactive toy via the handle at either 45° or 90° with no line-in active.

Intro Audio Plays

Wait for input from user

Idle plays after 30-45 seconds of idle

Idle-aware plays if volume threshold is passed but not held for 500 ms

The interactive toy turns of after 5 min of Idle 1 minute after OFF (idle or 0° forced sleep), the interactive toy may play an extended off SFX/VFX before finally shutting OFF. During this time, the interactive toy may shut down all systems except idle timer to trigger event.

Beat Box Mode Example: When user wants to interact with the interactive toy by mashing up music or sounds Beat Box (A)

Turn ON the interactive toy

Intro Audio Plays

Wait for input from user

Hold down the second button to record 5 sec of audio through microphone.

The interactive toy may prompt user to push first button to play audio.

Press first button to play back recorded audio.

Move the first button back and forth to overlay SFX and trigger animations.

Move the second button back and forth to increase or decrease the playback BPM.

After playback has finished, return to previous mode.

Beat Box (B)

While music is playing

Hold down the second button to record 5 sec of audio through line-in.

The interactive toy may disable line in

The interactive toy may prompt user to push first button to play

Press first button to play back recorded music.

Rotate first button and second button to overlay SFX and change the BPM of recorded music.

Beat Box (C)

At any time, Rotating first button may trigger SFX and VFX.

These SFX may only trigger if the interactive toy is not speaking.

These SFX can be overlaid on line-in music

Feed Me Mode Example: When user wants to interact with the interactive toy by being prompted to change a variable audio characteristic.

Feed Me Mode Example

Turn ON the interactive toy via rotation of handle to 45°

Intro Audio Plays

Wait for input from user

Insert 3.5 mm Audio MP3 player

Confirms 3.5 mm jack plugged in with SFX/VFX

The interactive toy may prompt user to play fast music, faster music, slow music or slower music.

If the request is FAST, the interactive toy may be metering for 100+BPM.

If the request is FASTER, the interactive toy may note the current BPM, and register any BPM 20 above current as FASTER.

If the request is SLOW, the interactive toy may be metering for <90BPM

If the request is SLOWER, the interactive toy may note the current BPM and register any BPM 20 below current as SLOWER.

If correct BPM change occurs in under 1:00 min, the interactive toy may respond positively.

Multiple correct answers may result in more positive, rewarding banter.

If correct BPM change does not occur after 1 minute, the interactive toy may respond negatively.

Multiple negative answers may result in negative banter.

Speaker Mode Example: When user wants to interact with the interactive toy by playing sounds Speaker Mode Example Turn ON the interactive toy via rotation of handle to 90°

Intro Audio Plays

Wait for input from user

Insert 3.5 mm Audio MP3 player

Confirms 3.5 mm jack plugged in with SFX/VFX

The interactive toy may play music without interaction

Dynamic Peak meter may reflect BPM speed periodically interrupted by animation Lightshows.

It is believed that the disclosure set forth herein encompasses multiple distinct inventions with independent utility. While each has been disclosed in an exemplary form, the specific embodiments thereof as disclosed and illustrated herein are not to be considered in a limiting sense, as numerous variations of the concepts and components are possible. The subject matter of the inventions includes all novel and non-obvious combinations and subcombinations of the various elements, features, functions and/or properties disclosed herein. Where the claims recite "a" or "a first" element or the equivalent thereof, such claims should be understood to include incorporation of one or more such elements, neither requiring nor excluding two or more such elements.

I claim:

1. An interactive toy for audio output comprising:

a housing having opposed first and second side portions;

a speaker contained within the housing;

an electrical signal defining an audio output to be generated by the speaker;

a humanoid face disposed between the first and second side portions and defined at least in part by lights contained within the housing, the humanoid face including a first part having a top end portion and a bottom end portion;

first and second control knobs configured to allow a user to change first and second variable audio characteristics, respectively, the first control knob being rotatably connected to the first side portion and the second control knob being rotatably connected to the second side portion;

a carrying handle rotatably attached to the housing, the carrying handle being movable independent of the first and second control knobs; and an information processer that:

measures a variable audio characteristic of the electrical signal;

prompts a user to change the variable audio characteristic;

controls a pattern scheme for the lights, including:

a first pattern scheme in which the lights illuminate in multiple ascending groups from the bottom end portion; and a second pattern scheme in which the lights illuminate in multiple descending groups from the top end portion, the second pattern scheme corresponding to an inverse of the first pattern scheme.

2. The interactive toy of claim 1, wherein a selection of the first pattern scheme or the second pattern scheme is dependent on the variable audio characteristic.

3. The interactive toy of claim 1, wherein at least one of the first pattern scheme and the second pattern scheme is a peak meter of the audio output.

4. The interactive toy of claim 3, wherein the second pattern scheme is displayed when the tempo of the audio output is greater than 100 beats-per-minute.

5. The interactive toy of claim 1, wherein the variable audio characteristic is the tempo of the audio output.

6. The interactive toy of claim 1, further comprising a user manipulable control member adjacent the humanoid face and configured to change the variable audio characteristic.

7. The interactive toy of claim 1, further comprising a third pattern scheme in which the lights illuminate in moving patterns that approximate a sine wave.

8. The interactive toy of claim 1, further comprising an expressive pattern scheme in which a plurality of lights mimics at least one of smiling, frowning, and talking.

9. The interactive toy of claim 1, wherein the information processor notifies a user that the variable audio characteristic has been changed.

10. The interactive toy of claim 1, wherein the illumination of the groups of lights in at least one of the first pattern schemes and the second pattern schemes is dependent on sound levels within each of a plurality of frequency bands of the audio output.

11. An interactive toy for audio output, comprising:

a housing having opposed first and second side portions;

a speaker contained within the housing;

an electrical signal defining an audio output to be generated by the speaker;

a humanoid face disposed between the first and second side portions and defined at least in part by lights contained within the housing;

first and second control knobs configured to allow a user to change first and second variable audio characteristics, respectively, the first control knob being rotatably connected to the first side portion and the second control knob being rotatably connected to the second side portion;

a carrying handle having first and second end portions, the first end portion being pivotably connected to the first side portion, the second end portion being pivotably connected to the second side portion, the carrying handle being movable among a plurality of positions including a first position associated with an off mode, a second position associated with an interactive mode, and a third position associated with a speaker mode; and an information processer that:

measures a variable audio characteristic of the electrical signal;

prompts a user to change a measured value of the variable audio characteristic;

controls a pattern scheme for the lights, including:

a first pattern scheme; and a second pattern scheme different from the first pattern scheme;

wherein a selection of the first pattern scheme or the second pattern scheme is dependent on the measured value of the variable audio characteristic when the carrying handle is in the second position.

12. The interactive toy of claim 11, wherein the displayed light pattern scheme is a peak meter when the carrying handle is in the third position.

13. The interactive toy of claim 11, wherein the variable audio characteristic is the tempo of the audio output.

14. The interactive toy of claim 11, further comprising a user manipulable control member adjacent the humanoid face and configured to change the measured value of the variable audio characteristic.

15. The interactive toy of claim 11, further comprising an expressive light pattern scheme in which a plurality of lights mimics at least one of smiling, frowning, and talking.

16. The interactive toy of claim 11, wherein the information processor notifies a user that the measured value of the variable audio characteristic has been changed correctly.

17. The interactive toy of claim 11, wherein at least one of the first pattern scheme and the second pattern scheme is a peak meter of the audio output.

18. An interactive toy for audio output, comprising:

a housing having opposed first and second side portions;

a speaker contained within the housing;

an electrical signal defining an audio output to be generated by the speaker;

a humanoid face disposed between the first and second side portions and defined at least in part by lights contained within the housing;

first and second control knobs configured to allow a user to change first and second variable audio characteristics, respectively, the first control knob being rotatably connected to the first side portion and the second control knob being rotatably connected to the second side portion;

a carrying handle having first and second end portions, the first end portion being pivotably connected to the first side portion adjacent to the first control knob, the second end portion being pivotably connected to the second side portion adjacent to the second control knob; and an information processer that:

measures a variable audio characteristic of the electrical signal;

prompts a user to change a measured value of the variable audio characteristic in a specified manner;

notifies the user whether the variable audio characteristic has been changed correctly; and controls a pattern scheme for the lights, including:

a first pattern scheme in which the lights illuminate in multiple ascending groups; and a second pattern scheme in which the lights illuminate in multiple descending groups;

wherein a selection of the first pattern scheme or the second pattern scheme is dependent on the measured value of the variable audio characteristic.

19. The interactive toy of claim 18, wherein the variable audio characteristic is the tempo of the audio output.

20. The interactive toy of claim 18, wherein the handle, first control knob, and second control knob collectively create a visual simulation of audio headphones worn by the humanoid face.

* * * * *